US011939538B2

(12) United States Patent
Al-Mana et al.

(10) Patent No.: US 11,939,538 B2
(45) **Date of Patent: *Mar. 26, 2024**

(54) INTEGRATED PROCESS FOR PYGAS UPGRADING TO BTX

(71) Applicant: Saudi Arabian Oil Company, Dhahran (SA)

(72) Inventors: Noor Nasser Al-Mana, Dhahran (SA); Zhonglin Zhang, Dhahran (SA); Omer Refa Koseoglu, Dhahran (SA); Sohel Shaikh, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

This patent is subject to a terminal disclaimer.

(21) Appl. No.: 18/115,239

(22) Filed: Feb. 28, 2023

(65) Prior Publication Data

US 2023/0212465 A1 Jul. 6, 2023

Related U.S. Application Data

(63) Continuation of application No. 17/567,466, filed on Jan. 3, 2022.

(51) Int. Cl.
*C10G 65/08* (2006.01)
*C10G 45/68* (2006.01)
(Continued)

(52) U.S. Cl.
CPC ..... *C10G 65/08* (2013.01); *C10G 45/68* (2013.01); *C10G 69/123* (2013.01); *C10G 45/40* (2013.01);
(Continued)

(58) Field of Classification Search
CPC .. C10G 45/36–40; C10G 45/64; C10G 45/68; C10G 61/02; C10G 61/04;
(Continued)

(56) References Cited

U.S. PATENT DOCUMENTS 3,843,740 A 10/1974 Mitchell et al.
3,953,366 A 4/1976 Morrison
(Continued)

FOREIGN PATENT DOCUMENTS

JP S6341592 A 2/1988

*Primary Examiner* — Renee Robinson
(74) *Attorney, Agent, or Firm* — Dinsmore & Shohl LLP

(57) ABSTRACT

In accordance with one or more embodiments of the present disclosure, a method for producing aromatic compounds from pyrolysis gasoline comprising $C_5$-$C_6$ non-aromatic hydrocarbons includes aromatizing the pyrolysis gasoline in an aromatization unit, thereby converting the $C_5$-$C_6$ non-aromatic hydrocarbons to a first stream comprising benzene-toluene-xylenes (BTX); hydrotreating the first stream comprising BTX in a selective hydrotreatment unit, thereby producing a de-olefinated stream comprising BTX hydrodealkylating and transalkylating the de-olefinated stream comprising BTX in a hydrodealkylation-transalkylation unit, thereby producing a second stream comprising BTX, the second stream comprising BTX having a greater amount of benzene and xylenes than the first stream comprising BTX; and processing the second stream comprising BTX in an aromatics recovery complex, thereby producing the aromatic compounds from the pyrolysis gasoline, the aromatic compounds comprising benzene, toluene, and xylenes.

20 Claims, 4 Drawing Sheets

(51) Int. Cl.

| | |
|---|---|
| ***C10G 69/12*** | (2006.01) |
| *C10G 45/40* | (2006.01) |
| *C10G 45/54* | (2006.01) |
| *C10G 45/64* | (2006.01) |

(52) U.S. Cl.
CPC ..... *C10G 45/54* (2013.01); *C10G 45/64* (2013.01); *C10G 2300/1044* (2013.01); *C10G 2300/4006* (2013.01); *C10G 2300/4012* (2013.01); *C10G 2300/4018* (2013.01); *C10G 2400/30* (2013.01)

(58) Field of Classification Search
CPC ..... C10G 63/02; C10G 69/12; C10G 69/123; C10G 2400/30
See application file for complete search history.

(56) References Cited

U.S. PATENT DOCUMENTS

| | | | | |
|---|---|---|---|---|
| 4,058,450 | A * | 11/1977 | Le Page ..... | C10G 59/02 208/66 |
| 4,304,657 | A | 12/1981 | Miller | |
| 4,499,316 | A | 2/1985 | Garska et al. | |
| 5,895,828 | A | 4/1999 | Yao et al. | |
| 5,898,089 | A | 4/1999 | Drake et al. | |
| 6,635,792 | B2 | 10/2003 | Choi et al. | |
| 8,563,795 | B2 | 10/2013 | Negiz et al. | |
| 9,181,146 | B2 | 11/2015 | Taccino et al. | |
| 9,181,147 | B2 | 11/2015 | Taccino et al. | |
| 2015/0166435 | A1* | 6/2015 | Serban ..... | C10G 63/08 422/187 |
| 2017/0058210 | A1 | 3/2017 | Pelaez et al. | |
| 2019/0153338 | A1 | 5/2019 | Charra et al. | |

* cited by examiner

INTEGRATED PROCESS FOR PYGAS UPGRADING TO BTX

CROSS REFERENCE TO RELATED APPLICATION

This application is a continuation of U.S. Non-Provisional application Ser. No. 17/567,466 filed Jan. 3, 2022, the entire contents of which are incorporated herein by reference.

FIELD

Embodiments of the present disclosure generally relate to refining and upgrading hydrocarbon oil, and pertain particularly to a process of producing aromatic compounds from pyrolysis gasoline.

TECHNICAL BACKGROUND

Steam cracking of gaseous hydrocarbons (ethane, propane, and the butanes) and liquid hydrocarbons (such as light naphtha having five or six carbon atoms) may be used for the production of ethylene. In the process, the feedstocks are diluted with steam and then sent to steam cracker furnaces. Steam cracking is a complex process followed by cooling, compression, and separation steps. Coking is an unwanted side reaction from steam cracking. Coking is a major operational problem in the radiant section of steam cracker furnaces and transfer line exchangers. However, coking can be somewhat controlled by steam dilution, which lowers the hydrocarbon partial pressure of the cracked compounds, thereby favoring the formation of primary reaction products. Indeed, the addition of steam reduces the tendency of coke deposition on the furnace surfaces.

Steam cracking produces $C_1$-$C_4$ light gases, including olefins such as ethylene, propylene, and the butylenes, and liquid products, including pyrolysis gasoline and fuel oil. The product composition depends on the feedstock used. For example, ethane crackers primarily produce ethylene and only small amounts of co-products, whereas naphtha crackers produce a range of olefins and aromatic compounds ("aromatics"), including butadiene, propylene and benzene.

Pyrolysis gasoline ("pygas") contains naphtha-range boiling hydrocarbons (such as from 36° C. to 205° C.) or $C_5$-$C_{12}$ hydrocarbons. In particular, pygas contains the relatively more valuable aromatics and $C_1$-$C_4$ paraffins and olefins, as well as the relatively lower value $C_5$ and greater non-aromatics. Because pygas contains a high concentration of aromatics, it has a high octane number and can be used as a gasoline blending component. It may also be a good source of benzene-toluene-xylenes ("BTX") and other aromatic compounds. However, the recovered amount of these higher value aromatics is limited by the amount of lower value $C_5$ and greater non-aromatics contained in the pygas.

SUMMARY

Therefore, there is a continual need for systems and processes for increasing the amount of higher value aromatics recovered from pygas upgrading. Described herein are processes and systems that allow for the recovery of an increased amount of aromatics as compared with the amount of aromatics recovered by other processes.

According to an embodiment, a method for producing aromatic compounds from pyrolysis gasoline comprising $C_5$-$C_6$ non-aromatic hydrocarbons includes aromatizing the pyrolysis gasoline in an aromatization unit, thereby converting the $C_5$-$C_6$ non-aromatic hydrocarbons to a first stream comprising benzene-toluene-xylenes (BTX); hydrotreating the first stream comprising BTX in a selective hydrotreatment unit, thereby producing a de-olefinated stream comprising BTX; hydrodealkylating and transalkylating the de-olefinated stream comprising BTX in a hydrodealkylation-transalkylation unit, thereby producing a second stream comprising BTX, the second stream comprising BTX having a greater amount of benzene and xylenes than the first stream comprising BTX; and processing the second stream comprising BTX in an aromatics recovery complex, thereby producing the aromatic compounds from the pyrolysis gasoline, the aromatic compounds comprising benzene, toluene, and xylenes.

Additional features and advantages of the embodiments described herein will be set forth in the detailed description which follows, and in part will be readily apparent to those skilled in the art from that description or recognized by practicing the embodiments described, including the detailed description and the claims which are provided infra.

BRIEF DESCRIPTION OF THE DRAWINGS

The following detailed description of specific embodiments of the present disclosure can be best understood when read in conjunction with the following drawings in which.

DETAILED DESCRIPTION

Figure 1:
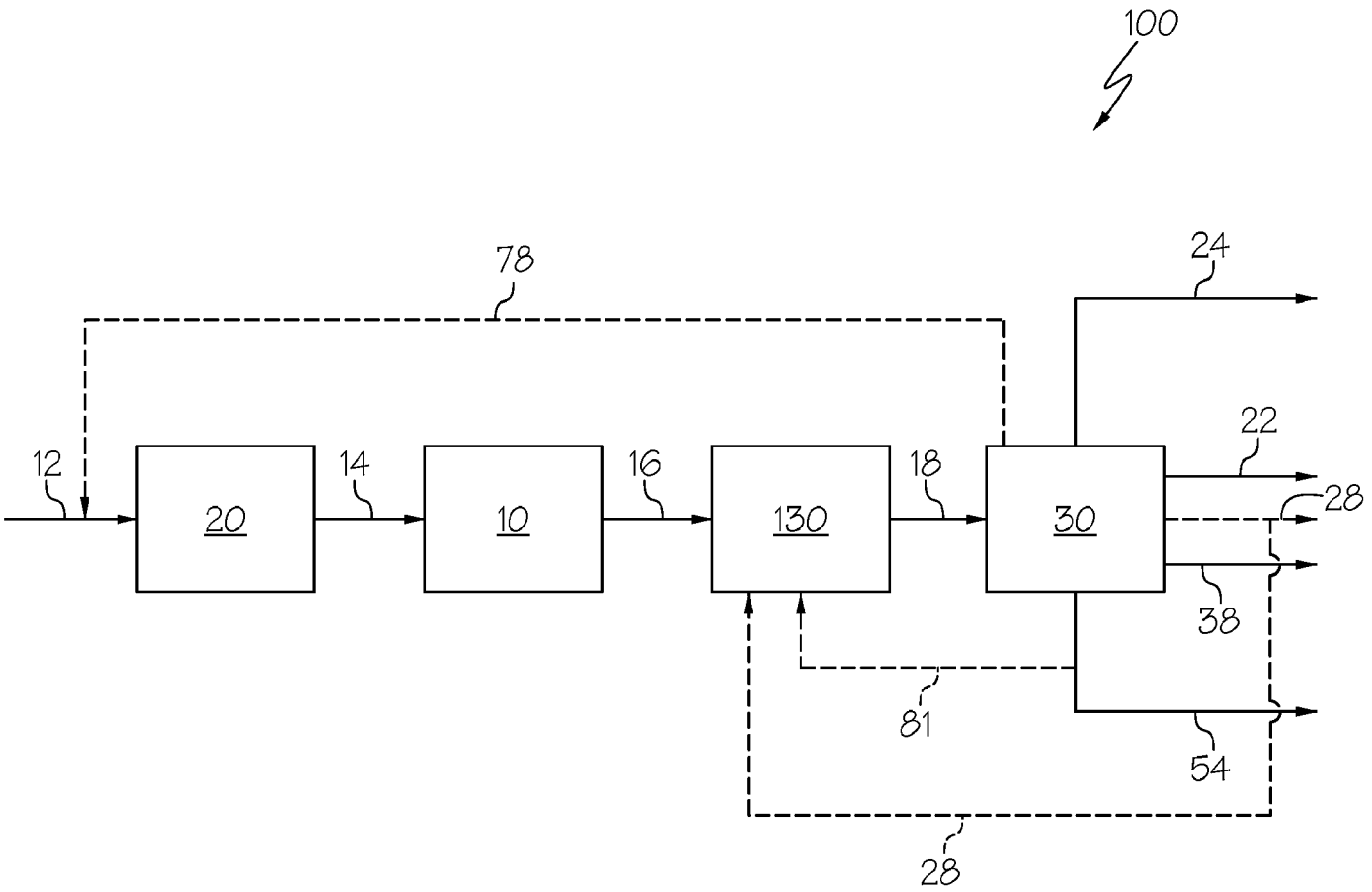
FIG. 1 is a process flow diagram for an exemplary process in accordance with embodiments described herein.

As used herein, the term "hydrocarbon oil" or "hydrocarbon feedstock" refers to an oily liquid composed mostly of a mixture of hydrocarbon compounds. Hydrocarbon oil may include refined oil obtained from crude oil, synthetic crude oil, bitumen, oil sand, shale oil, or coal oil. The term "refined oil" includes, but is not limited to, vacuum gas oil (VGO), deasphalted oil (DAO) obtained from a solvent deasphalting process, demetallized oil (DMO), light and/or heavy coker gas oil obtained from a coker process, cycle oil obtained from a fluid catalytic cracking (FCC) process, and gas oil obtained from a visbreaking process.

As used herein, the term "hydrocarbon" refers to a chemical compound composed entirely of carbon and hydrogen atoms. An expression such as "$C_x$-$C_y$ hydrocarbon" refers to a hydrocarbon having from x to y carbon atoms. For instance, a $C_1$-$C_5$ hydrocarbon includes methane, ethane, propane, the butanes, and the pentanes.

As used herein, the term "liquid hourly space velocity" or "LHSV" refers to the ratio of the liquid flow rate of the hydrocarbon feed to the catalyst volume or mass.

As used herein, the term "weight hourly space velocity" or "WHSV" refers to the ratio of the weight of reagent flow to the catalyst weight.

As used herein, the term "conduit" includes casings, liners, pipes, tubes, coiled tubing, and mechanical structures with interior voids.

As used herein, the term "hydrogen/oil ratio" or "hydrogen-to-oil ratio" or "hydrogen-to-hydrocarbon ratio" refers to a standard measure of the volume rate of hydrogen circulating through the reactor with respect to the volume of feed. The hydrogen/oil ratio may be determined by comparing the flow volume of the hydrogen gas stream and the flow volume of the hydrocarbon feed.

As used herein, the term "decreased content" of a substance means that a concentration of the substance is greater before passing through a stage of the process under examination than it is after passing through the stage. As used herein, the term "increased content" of a substance means that a concentration of the substance is greater after passing through a stage of the process under examination than it is before passing through the stage.

As used herein, any stream that is referred to as"rich" in some chemical species contains 50% or more by volume of that chemical species.

In accordance with one or more embodiments, the present application discloses systems and methods for producing aromatic compounds from pyrolysis gasoline comprising $C_5$-$C_6$ non-aromatic hydrocarbons. The method includes aromatizing the pyrolysis gasoline in an aromatization unit, thereby converting the $C_5$-$C_6$ non-aromatic hydrocarbons to a first stream comprising benzene-toluene-xylenes (BTX); hydrotreating the first stream comprising BTX in a selective hydrotreatment unit, thereby producing a de-olefinated stream comprising BTX; hydrodealkylating and transalkylating the de-olefinated stream comprising BTX in a hydrodealkylation-transalkylation unit, thereby producing a second stream comprising BTX, the second stream comprising BTX having a greater amount of benzene and xylenes than the first stream comprising BTX; and processing the second stream comprising BTX in an aromatics recovery complex, thereby producing the aromatic compounds from the pyrolysis gasoline, the aromatic compounds comprising benzene, toluene, and xylenes. This process will now be described in greater detail.

The pyrolysis gasoline stream may be aromatized in an aromatization unit, thereby producing a first stream comprising BTX. An exemplary pygas formulation may include from 15 weight % ("wt %") to 20 wt % paraffins; from 1.5 wt % to 3 wt % naphthenes; from 50 wt % to 70 wt % aromatic hydrocarbons; from 1 wt % to 2 wt % di-aromatic hydrocarbons; from 5 wt % to 10 wt % olefins; and from 7 wt % to 9 wt % di-olefins. In embodiments, the sum of the concentration of each of the above components of pygas is about 100 wt %, such as from 99.5 wt % to 100.5 wt %, which allows for the presence of impurities and experimental variation. In the aromatization unit, the paraffins are converted, at least partially, to BTX by undergoing cyclization, dealkylation, and/or hydrodealkylation reactions. In embodiments, the aromatizing may include contacting the hydrotreated pyrolysis gasoline stream with a catalyst comprising a zeolite. In embodiments, the zeolite may include a Y-type zeolite, a ZSM-5-type zeolite, or a combination of the Y-type zeolite and the ZSM-5-type zeolite. In embodiments, a single reactor may be used for all of cyclization, dealkylation, and hydrodealkylation. In other embodiments, more than one reactor, such as two reactors, may be used to perform cyclization, dealkylation, and hydrodealkylation. For instance, one reactor may be used for cyclization and another reactor may be used for dealkylation and/or hydrodealkylation. In embodiments using more than one reactor, the catalyst may be the same or different in each reactor. Further, the temperature, pressure, and WHSV may all be the same or different in each reactor.

In embodiments, the aromatization unit may be operated at a temperature from 200° C. to 700° C., from 200° C. to 650° C., from 200° C. to 600° C., from 200° C. to 550° C., from 200° C. to 500° C., from 200° C. to 450° C., from 200° C. to 400° C., from 200° C. to 350° C., from 200° C. to 300° C., from 200° C. to 250° C., from 250° C. to 700° C., from 300° C. to 950° C., from 350° C. to 700° C., from 400° C. to 700° C., from 450° C. to 700° C., from 450° C. to 650° C., from 500° C. to 700° C., from 500° C. to 600° C., from 525° C. to 575° C., from 550° C. to 700° C., from 600° C. to 700° C., or even from 650° C. to 700° C. It should be understood that the temperature may be from any lower bound for such temperature disclosed herein to any upper bound for such temperature disclosed herein. Without intending to be bound by any particular theory, it is believed that having a reactor temperature below 200° C. may cause the cyclization, dealkylation, and/or hydrodealkylation reactions to proceed too slowly to be commercially viable, but having a reactor temperature above 700° C. may cause polymerization of species found in the reactor, thereby coking the catalyst.

In embodiments, the aromatization unit may be operated at a pressure from 0.1 MPa to 3 MPa, from 0.1 MPa to 2.9 MPa, from 0.1 MPa to 2.8 MPa, from 0.1 MPa to 2.7 MPa, from 0.1 MPa to 2.6 MPa, from 0.1 MPa to 2.5 MPa, from 0.1 MPa to 2.4 MPa, from 0.1 MPa to 2.3 MPa, from 0.1 MPa to 2.2 MPa, from 0.1 MPa to 2.1 MPa, from 0.1 MPa to 2 MPa, from 0.1 MPa to 1.9 MPa, from 0.1 MPa to 1.8 MPa, from 0.1 MPa to 1.7 MPa, from 0.1 MPa to 1.6 MPa, from 0.1 MPa to 1.5 MPa, from 0.1 MPa to 1.4 MPa, from 0.1 MPa to 1.3 MPa, from 0.1 MPa to 1.2 MPa, from 0.1 MPa to 1.1 MPa, from 0.1 MPa to 1 MPa, from 0.1 MPa to 0.9 MPa, from 0.1 MPa to 0.8 MPa, from 0.1 MPa to 0.7 MPa, from 0.1 MPa to 0.6 MPa, from 0.1 MPa to 0.5 MPa, from 0.1 MPa to 0.4 MPa, from 0.1 MPa to 0.3 MPa, from 0.1 MPa to 0.2 MPa, from 0.2 MPa to 3 MPa, from 0.3 MPa to 3 MPa, from 0.4 MPa to 3 MPa, from 0.5 MPa to 3 MPa, from 0.6 MPa to 3 MPa, from 0.7 MPa to 3 MPa, from 0.8 MPa to 3 MPa, from 0.9 MPa to 3 MPa, from 1 MPa to 3 MPa, from 1.1 MPa to 3 MPa, from 1.2 MPa to 3 MPa, from 1.3 MPa to 3 MPa, from 1.4 MPa to 3 MPa, from 1.5 MPa to 3 MPa, from 1.6 MPa to 3 MPa, from 1.7 MPa to 3 MPa, from 1.8 MPa to 3 MPa, from 1.9 MPa to 3 MPa, from 2 MPa to 3 MPa, from 2.1 MPa to 3 MPa, from 2.2 MPa to 3 MPa, from 2.3 MPa to 3 MPa, from 2.4 MPa to 3 MPa, from 2.5 MPa to 3 MPa, from 2.6 MPa to 3 MPa, from 2.7 MPa to 3 MPa, from 2.8 MPa to 3 MPa, or even from 2.9 MPa to 3 MPa. It should be understood that the operating pressure may be from any lower bound for such pressure disclosed herein to any upper bound for such pressure disclosed herein. Without intending to be bound by any particular theory, it is believed that a pressure below 0.1 MPa may be insufficient for the cyclization, dealkylation, and/or hydrodealkylation to take place. However, at a pressure above 3 MPa, specialized high-pressure equipment may become necessary, which would increase the cost of performing the reaction.

In embodiments, the aromatization unit may be operated at a WHSV from 0.1 $h^{-1}$ to 20 $h^{-1}$, from 0.1 $h^{-1}$ to 19 $h^{-1}$, from 0.1 $h^{-1}$ to 18 $h^{-1}$, from 0.1 $h^{-1}$ to 17 $h^{-1}$, from 0.1 $h^{-1}$ to 16 $h^{-1}$, from 0.1 $h^{-1}$ to 15 $h^{-1}$, from 0.1 $h^{-1}$ to 14 $h^{-1}$, from 0.1 $h^{-1}$ to 13 $h^{-1}$, from 0.1 $h^{-1}$ to 12 $h^{-1}$, from 0.1 $h^{-1}$ to 11 $h^{-1}$, from 0.1 $h^{-1}$ to 10 $h^{-1}$, from 0.1 $h^{-1}$ to 9 $h^{-1}$, from 0.1 $h^{-1}$ to 8 $h^{-1}$, from 0.1 $h^{-1}$ to 7 $h^{-1}$, from 0.1 $h^{-1}$ to 6 $h^{-1}$, from 0.1 $h^{-1}$ to 5 $h^{-1}$, from 0.1 $h^{-1}$ to 4 $h^{-1}$, from 0.1 $h^{-1}$ to 3 $h^{-1}$, from 0.1 $h^{-1}$ to 2 $h^{-1}$, from 0.1 $h^{-1}$ to 1 $h^{-1}$, from 0.5 to 5 $h^{-1}$, from 0.75 to 1.25 $h^{-1}$, from 1 $h^{-1}$ to 20 $h^{-1}$, from 2 $h^{-1}$ to 20 $h^{-1}$, from 3 $h^{-1}$ to 20 $h^{-1}$, from 4 $h^{-1}$ to 20 $h^{-1}$, from 5 $h^{-1}$ to 20 $h^{-1}$, from 6 $h^{-1}$ to 20 $h^{-1}$, from 7 $h^{-1}$ to 20 $h^{-1}$, from 8 $h^{-1}$ to 20 $h^{-1}$, from 9 $h^{-1}$ to 20 $h^{-1}$, from 10 $h^{-1}$ to 20 $h^{-1}$, from 11 $h^{-1}$ to 20 $h^{-1}$, from 12 $h^{-1}$ to 20 $h^{-1}$, from 13 $h^{-1}$ to 20 $h^{-1}$, from 14 $h^{-1}$ to 20 $h^{-1}$, from 15 $h^{-1}$ to 20 $h^{-1}$, from 16 $h^{-1}$ to 20 $h^{-1}$, from 17 $h^{-1}$ to 20 $h^{-1}$, from 18 $h^{-1}$ to 20 $h^{-1}$, or even from 19 $h^{-1}$ to 20 $h^{-1}$. It should be understood that the WHSV may be from any lower bound for such WHSV disclosed herein to any upper bound for such WHSV disclosed herein. Without intending to be bound by any particular theory, it is believed that a WHSV below 0.1 $h^{-1}$ may require a catalyst volume and/or reactor volume that is too large to be commercially viable, or a higher residence time of the reactants may be necessary, thereby leading to a decreased amount of time to catalyst deactivation. However, a WHSV above 20 $h^{-1}$ may cause a residence time of the reactants in the reactor that is too short to allow the hydrogenation to proceed.

After aromatization, the resulting aromatic-rich stream ("first stream comprising BTX") may undergo hydrotreatment to decrease the content of di-olefins and mono-olefins relative to the starting pygas stream. For instance, in some embodiments the hydrotreated stream may not contain any di-olefins or mono-olefins. In other embodiments, the hydrotreated stream may contain from 0 ppm to 100 ppm di-olefins and mono-olefins, such as from 10 ppm to 90 ppm di-olefins and mono-olefins or from 50 ppm to 90 ppm di-olefins and mono-olefins or from 60 ppm to 80 ppm di-olefins and mono-olefins or about 70 ppm di-olefins and mono-olefins.

In embodiments, the hydrotreatment may take place in a reactor selected from the group consisting of a fixed-bed reactor, an ebullated-bed reactor, a moving bed reactor, a slurry bed reactor, and a combination of two or more thereof. The reactor may include a catalyst composition that includes an active-phase metal on a support. In embodiments, the active-phase metal may be selected from the group consisting of nickel, molybdenum, tungsten, platinum, palladium, rhodium, ruthenium, gold, and a combination of two or more of these. In embodiments, the support may be selected from the group consisting of amorphous alumina, crystalline silica-alumina, alumina, silica, and a combination of two or more thereof. In embodiments, hydrotreatment may take place at a temperature from 160° C. to 400° C., a pressure from 2 MPa to 10 MPa, a LHSV from 1 $h^{-1}$ to 8 $h^{-1}$, and a hydrogen-to-oil ratio from 100 L/L to 2000 L/L.

Hydrotreatment processes may remove the olefins in one step or two steps depending upon the di-olefin and mono-olefin concentrations within the untreated stream. Di-olefin hydrogenation may take place at significantly lower pressures and/or temperatures than mono-olefin hydrogenation. Thus, di-olefins may be selectively hydrogenated prior to the hydrogenation of mono-olefins, with the di-olefins being converted to mono-olefins in this first step. An optional second step, then, may be a higher-pressure and/or higher temperature selective mono-olefin removal step.

In embodiments, hydrogenation of the di-olefins may take place in a reactor at a temperature from 160° C. to 220° C. The temperature for hydrogenation of di-olefins may be, for example, from 160° C. to 210° C., from 160° C. to 200° C., from 160° C. to 190° C., from 160° C. to 180° C., from 160° C. to 170° C., from 170° C. to 220° C., from 180° C. to 220° C., from 190° C. to 220° C., from 200° C. to 220° C., or even from 210° C. to 220° C. It should be understood that the temperature may be from any lower bound for such temperature disclosed herein to any upper bound for such temperature disclosed herein. Without intending to be bound by any particular theory, it is believed that having a reactor temperature below 160° C. may cause the hydrogenation to proceed too slowly to be commercially viable, but having a reactor temperature above 220° C. may cause the di-olefins to polymerize, thereby blocking the catalyst pores.

The hydrogen pressure at the inlet of the reactor in which hydrogenation of di-olefins takes place may be from 1 MPa to 2 MPa, from 1 MPa to 1.9 MPa, from 1 MPa to 1.8 MPa, from 1 MPa to 1.7 MPa, from 1 MPa to 1.6 MPa, from 1 MPa to 1.5 MPa, from 1 MPa to 1.4 MPa, from 1 MPa to 1.3 MPa, from 1 MPa to 1.2 MPa, from 1 MPa to 1.1 MPa, from 1.1 MPa to 2 MPa, from 1.2 MPa to 2 MPa, from 1.3 MPa to 2 MPa, from 1.4 MPa to 2 MPa, from 1.5 MPa to 2 MPa, from 1.6 MPa to 2 MPa, from 1.7 MPa to 2 MPa, from 1.8 MPa to 2 MPa, or even from 1.9 MPa to 2 MPa. It should be understood that the hydrogen pressure may be from any lower bound for such pressure disclosed herein to any upper bound for such pressure disclosed herein. Without intending to be bound by any particular theory, it is believed that a hydrogen partial pressure below 1 MPa may be insufficient for the hydrogenation to take place and lead to a faster deactivation of the catalyst. However, at a hydrogen partial pressure above 2 MPa, specialized high-pressure equipment may become necessary, which would increase the cost of performing the hydrogenation.

In embodiments, the reactor used for hydrogenation of di-olefins may be operated at a WHSV from 1 $h^{-1}$ to 2 $h^{-1}$, from 1 $h^{-1}$ to 1.9 $h^{-1}$, from 1 $h^{-1}$ to 1.8 $h^{-1}$, from 1 $h^{-1}$ to 1.7 $h^{-1}$, from 1 $h^{-1}$ to 1.6 $h^{-1}$, from 1 $h^{-1}$ to 1.5 $h^{-1}$, from 1 $h^{-1}$ to 1.4 $h^{-1}$, from 1 $h^{-1}$ to 1.3 $h^{-1}$, from 1 $h^{-1}$ to 1.2 $h^{-1}$, from 1 $h^{-1}$ to 1.1 $h^{-1}$, from 1.1 $h^{-1}$ to 2 $h^{-1}$, from 1.2 $h^{-1}$ to 2 $h^{-1}$, from 1.3 $h^{-1}$ to 2 $h^{-1}$, from 1.4 $h^{-1}$ to 2 $h^{-1}$, from 1.5 $h^{-1}$ to 2 $h^{-1}$, from 1.6 $h^{-1}$ to 2 $h^{-1}$, from 1.7 $h^{-1}$ to 2 $h^{-1}$, from 1.8 $h^{-1}$ to 2 $h^{-1}$, or even from 1.9 $h^{-1}$ to 2 $h^{-1}$. It should be understood that the WHSV may be from any lower bound for such WHSV disclosed herein to any upper bound for such WHSV disclosed herein. Without intending to be bound by any particular theory, it is believed that a WHSV below 1 $h^{-1}$ may require a catalyst volume and/or reactor volume that is too large to be commercially viable. However, a WHSV above 2 $h^{-1}$ may cause a residence time of the reactants in the reactor that is too short to allow the hydrogenation to proceed.

In embodiments, the hydrogen used for di-olefin hydrogenation may be recycled into the reactor at a hydrogen recycle rate from 50 $N \cdot m^3/m^3$ to 150 $N \cdot m^3/m^3$, from 50 $N \cdot m^3/m^3$ to 140 $N \cdot m^3/m^3$, from 50 $N \cdot m^3/m^3$ to 130 $N \cdot m^3/m^3$, from 50 $N \cdot m^3/m^3$ to 120 $N \cdot m^3/m^3$, from 50 $N \cdot m^3/m^3$ to 110 $N \cdot m^3/m^3$, from 50 $N \cdot m^3/m^3$ to 100 $N \cdot m^3/m^3$, from 50 $N \cdot m^3/m^3$ to 90 $N \cdot m^3/m^3$, from 50 $N \cdot m^3/m^3$ to 80 $N \cdot m^3/m^3$, from 50 $N \cdot m^3/m^3$ to 70 $N \cdot m^3/m^3$, from 50 $N \cdot m^3/m^3$ to 60 $N \cdot m^3/m^3$, from 60 $N \cdot m^3/m^3$ to 150 $N \cdot m^3/m^3$, from 70 $N \cdot m^3/m^3$ to 150 $N \cdot m^3/m^3$, from 80 $N \cdot m^3/m^3$ to 150 $N \cdot m^3/m^3$, from 90 $N \cdot m^3/m^3$ to 150 $N \cdot m^3/m^3$, from 100 $N \cdot m^3/m^3$ to 150 $N \cdot m^3/m^3$, from 110 $N \cdot m^3/m^3$ to 150 $N \cdot m^3/m^3$, from 120 $N \cdot m^3/m^3$ to 150 $N \cdot m^3/m^3$, from 130 $N \cdot m^3/m^3$ to 150 $N \cdot m^3/m^3$, or even from 140 $N \cdot m^3/m^3$ to 150 $N \cdot m^3/m^3$. It should be understood that the hydrogen recycle rate may be from any lower bound for such hydrogen recycle rate disclosed herein to any upper bound for such hydrogen recycle rate disclosed herein. Without intending to be bound by any particular theory, it is believed that a hydrogen recycle rate less than 50 $N \cdot m^3/m^3$ may not allow sufficient levels of hydrogen into the reactor. However, a hydrogen recycle rate greater than 150 $N \cdot m^3/m^3$ may cause too much hydrogen to circulate within the system, such that an unacceptable amount of the hydrogen is consumed.

In embodiments, hydrogenation of the mono-olefins may take place in a reactor at a temperature from 270° C. to 330°

C. The temperature for hydrogenation of di-olefins may be, for example, from 270° C. to 320° C., from 270° C. to 310° C., from 270° C. to 300° C., from 270° C. to 290° C., from 270° C. to 280° C., from 280° C. to 330° C., from 290° C. to 330° C., from 300° C. to 330° C., from 310° C. to 330° C., or even from 320° C. to 330° C. It should be understood that the temperature may be from any lower bound for such temperature disclosed herein to any upper bound for such temperature disclosed herein. Without intending to be bound by any particular theory, it is believed that having a reactor temperature below 270° C. may cause the hydrogenation of the mono-olefins to proceed too slowly to be commercially viable, but having a reactor temperature above 330° C. may cause polymerization of species found in the reactor, thereby coking the catalyst.

The hydrogen pressure at the inlet of the reactor in which hydrogenation of mono-olefins takes place may be from 1 MPa to 2 MPa, from 1 MPa to 1.9 MPa, from 1 MPa to 1.8 MPa, from 1 MPa to 1.7 MPa, from 1 MPa to 1.6 MPa, from 1 MPa to 1.5 MPa, from 1 MPa to 1.4 MPa, from 1 MPa to 1.3 MPa, from 1 MPa to 1.2 MPa, from 1 MPa to 1.1 MPa, from 1.1 MPa to 2 MPa, from 1.2 MPa to 2 MPa, from 1.3 MPa to 2 MPa, from 1.4 MPa to 2 MPa, from 1.5 MPa to 2 MPa, from 1.6 MPa to 2 MPa, from 1.7 MPa to 2 MPa, from 1.8 MPa to 2 MPa, or even from 1.9 MPa to 2 MPa. It should be understood that the hydrogen pressure may be from any lower bound for such pressure disclosed herein to any upper bound for such pressure disclosed herein. Without intending to be bound by any particular theory, it is believed that a hydrogen partial pressure below 1 MPa may be insufficient for the hydrogenation to take place and lead to a faster deactivation of the catalyst. However, at a hydrogen partial pressure above 2 MPa, specialized high-pressure equipment may become necessary, which would increase the cost of performing the hydrogenation.

In embodiments, the reactor used for hydrogenation of mono-olefins may be operated at a WHSV from 1 $h^{-1}$ to 2 $h^{-1}$, from 1 $h^{-1}$ to 1.9 $h^{-1}$, from 1 $h^{-1}$ to 1.8 $h^{-1}$, from 1 $h^{-1}$ to 1.7 $h^{-1}$, from 1 $h^{-1}$ to 1.6 $h^{-1}$, from 1 $h^{-1}$ to 1.5 $h^{-1}$, from 1 $h^{-1}$ to 1.4 $h^{-1}$, from 1 $h^{-1}$ to 1.3 $h^{-1}$, from 1 $h^{-1}$ to 1.2 $h^{-1}$, from 1 $h^{-1}$ to 1.1 $h^{-1}$, from 1.1 $h^{-1}$ to 2 $h^{-1}$, from 1.2 $h^{-1}$ to 2 $h^{-1}$, from 1.3 $h^{-1}$ to 2 $h^{-1}$, from 1.4 $h^{-1}$ to 2 $h^{-1}$, from 1.5 $h^{-1}$ to 2 $h^{-1}$, from 1.6 $h^{-1}$ to 2 $h^{-1}$, from 1.7 $h^{-1}$ to 2 $h^{-1}$, from 1.8 $h^{-1}$ to 2 $h^{-1}$, or even from 1.9 $h^{-1}$ to 2 $h^{-1}$. It should be understood that the WHSV may be from any lower bound for such WHSV disclosed herein to any upper bound for such WHSV disclosed herein. Without intending to be bound by any particular theory, it is believed that a WHSV below 1 $h^{-1}$ may require a catalyst volume and/or reactor volume that is too large to be commercially viable. However, a WHSV above 2 $h^{-1}$ may cause a residence time of the reactants in the reactor that is too short to allow the hydrogenation to proceed.

In embodiments, the hydrogen used for di-olefin hydrogenation may be recycled into the reactor at a hydrogen recycle rate from 250 $N \cdot m^3/m^3$ to 750 $N \cdot m^3/m^3$, from 250 $N \cdot m^3/m^3$ to 700 $N \cdot m^3/m^3$, from 250 $N \cdot m^3/m^3$ to 650 $N \cdot m^3/m^3$, from 250 $N \cdot m^3/m^3$ to 600 $N \cdot m^3/m^3$, from 250 $N \cdot m^3/m^3$ to 550 $N \cdot m^3/m^3$, from 250 $N \cdot m^3/m^3$ to 500 $N \cdot m^3/m^3$, from 250 $N \cdot m^3/m^3$ to 450 $N \cdot m^3/m^3$, from 250 $N \cdot m^3/m^3$ to 400 $N \cdot m^3/m^3$, from 250 $N \cdot m^3/m^3$ to 350 $N \cdot m^3/m^3$, from 250 $N \cdot m^3/m^3$ to 300 $N \cdot m^3/m^3$, from 300 $N \cdot m^3/m^3$ to 750 $N \cdot m^3/m^3$, from 350 $N \cdot m^3/m^3$ to 750 $N \cdot m^3/m^3$, from 400 $N \cdot m^3/m^3$ to 750 $N \cdot m^3/m^3$, from 450 $N \cdot m^3/m^3$ to 750 $N \cdot m^3/m^3$, from 500 $N \cdot m^3/m^3$ to 750 $N \cdot m^3/m^3$, from 550 $N \cdot m^3/m^3$ to 750 $N \cdot m^3/m^3$, from 600 $N \cdot m^3/m^3$ to 750 $N \cdot m^3/m^3$, from 650 $N \cdot m^3/m^3$ to 750 $N \cdot m^3/m^3$, or even from 700 $N \cdot m^3/m^3$ to 750 $N \cdot m^3/m^3$. It should be understood that the hydrogen recycle rate may be from any lower bound for such hydrogen recycle rate disclosed herein to any upper bound for such hydrogen recycle rate disclosed herein. Without intending to be bound by any particular theory, it is believed that a hydrogen recycle rate less than 250 $N \cdot m^3/m^3$ may not allow sufficient levels of hydrogen into the reactor. However, a hydrogen recycle rate greater than 750 $N \cdot m^3/m^3$ may cause too much hydrogen to circulate within the system, such that an unacceptable amount of the hydrogen is consumed.

After hydrotreating, the resulting de-olefinated stream may then be passed to a hydrodealkylation-transalkylation unit, in which at least a portion of the toluene and $C_9$ aromatic hydrocarbons in the de-olefinated stream may be converted to benzene and xylenes. The resulting product stream may be referred to as a "second stream comprising BTX," and this second stream comprising BTX may have a greater amount of benzene and xylenes than the first stream comprising BTX.

In embodiments, the hydrodealkylation-transalkylation may take place in a fixed-bed reactor. The reactor may be charged with a catalyst composition that includes an active metal supported on a mesoporous zeolite. The active metal may be, for example, nickel, molybdenum, tungsten, platinum, palladium, or a mixture of two or more of these. The support may be, for example, a mesoporous zeolite such as beta mordenite or ZSM-5.

In embodiments, the hydrodealkylation-transalkylation reactor may be operated at a temperature from 300° C. to 500° C., such as from 300° C. to 490° C., from 300° C. to 480° C., from 300° C. to 470° C., from 300° C. to 460° C., from 300° C. to 450° C., from 300° C. to 440° C., from 300° C. to 430° C., from 300° C. to 420° C., from 300° C. to 410° C., from 300° C. to 400° C., from 300° C. to 390° C., from 300° C. to 380° C., from 300° C. to 370° C., from 300° C. to 360° C., from 300° C. to 350° C., from 300° C. to 340° C., from 300° C. to 330° C., from 300° C. to 320° C., from 300° C. to 310° C., from 310° C. to 500° C., from 320° C. to 500° C., from 330° C. to 500° C., from 340° C. to 500° C., from 350° C. to 500° C., from 360° C. to 500° C., from 370° C. to 500° C., from 380° C. to 500° C., from 380° C. to 480° C., from 390° C. to 500° C., from 400° C. to 500° C., from 410° C. to 500° C., from 420° C. to 500° C., from 430° C. to 500° C., from 440° C. to 500° C., from 450° C. to 500° C., from 460° C. to 500° C., from 470° C. to 500° C., from 480° C. to 500° C., or even from 490° C. to 500° C. It should be understood that the temperature may be from any lower bound for such temperature disclosed herein to any upper bound for such temperature disclosed herein. Without intending to be bound by any particular theory, it is believed that having a reactor temperature below 300° C. may cause the hydrodealkylation and transalkylation reactions to proceed too slowly to be commercially viable, but having a reactor temperature above 500° C. may cause an increase in undesirable byproducts, thereby decreasing the effectiveness of this stage.

In embodiments, the hydrodealkylation-transalkylation reactor may be operated at a pressure from 1.5 MPa to 6 MPa, such as from 1.5 MPa to 5.9 MPa, from 1.5 MPa to 5.8 MPa, from 1.5 MPa to 5.7 MPa, from 1.5 MPa to 5.6 MPa, from 1.5 MPa to 5.5 MPa, from 1.5 MPa to 5.4 MPa, from 1.5 MPa to 5.3 MPa, from 1.5 MPa to 5.2 MPa, from 1.5 MPa to 5.1 MPa, from 1.5 MPa to 5 MPa, from 1.5 MPa to 4.9 MPa, from 1.5 MPa to 4.8 MPa, from 1.5 MPa to 4.7 MPa, from 1.5 MPa to 4.6 MPa, from 1.5 MPa to 4.5 MPa, from 1.5 MPa to 4.4 MPa, from 1.5 MPa to 4.3 MPa, from 1.5 MPa to 4.2 MPa, from 1.5 MPa to 4.1 MPa, from 1.5

MPa to 4 MPa, from 1.5 MPa to 3.9 MPa, from 1.5 MPa to 3.8 MPa, from 1.5 MPa to 3.7 MPa, from 1.5 MPa to 3.6 MPa, from 1.5 MPa to 3.5 MPa, from 1.5 MPa to 3.4 MPa, from 1.5 MPa to 3.3 MPa, from 1.5 MPa to 3.2 MPa, from 1.5 MPa to 3.1 MPa, from 1.5 MPa to 3 MPa, from 1.5 MPa to 2.9 MPa, from 1.5 MPa to 2.8 MPa, from 1.5 MPa to 2.7 MPa, from 1.5 MPa to 2.6 MPa, from 1.5 MPa to 2.5 MPa, from 1.5 MPa to 2.4 MPa, from 1.5 MPa to 2.3 MPa, from 1.5 MPa to 2.2 MPa, from 1.5 MPa to 2.1 MPa, from 1.5 MPa to 2 MPa, from 1.5 MPa to 1.9 MPa, from 1.5 MPa to 1.8 MPa, from 1.5 MPa to 1.7 MPa, from 1.5 MPa to 1.6 MPa, from 1.6 MPa to 6 MPa, from 1.7 MPa to 6 MPa, from 1.8 MPa to 6 MPa, from 1.9 MPa to 6 MPa, from 2 MPa to 6 MPa, from 2.1 MPa to 6 MPa, from 2.2 MPa to 6 MPa, from 2.3 MPa to 6 MPa, from 2.4 MPa to 6 MPa, from 2.5 MPa to 6 MPa, from 2.6 MPa to 6 MPa, from 2.7 MPa to 6 MPa, from 2.8 MPa to 6 MPa, from 2.9 MPa to 6 MPa, from 3 MPa to 6 MPa, from 3.1 MPa to 6 MPa, from 3.2 MPa to 6 MPa, from 3.3 MPa to 6 MPa, from 3.4 MPa to 6 MPa, from 3.5 MPa to 6 MPa, from 3.6 MPa to 6 MPa, from 3.7 MPa to 6 MPa, from 3.8 MPa to 6 MPa, from 3.9 MPa to 6 MPa, from 4 MPa to 6 MPa, from 4.1 MPa to 6 MPa, from 4.2 MPa to 6 MPa, from 4.3 MPa to 6 MPa, from 4.4 MPa to 6 MPa, from 4.5 MPa to 6 MPa, from 4.6 MPa to 6 MPa, from 4.7 MPa to 6 MPa, from 4.8 MPa to 6 MPa, from 4.9 MPa to 6 MPa, from 5 MPa to 6 MPa, from 5.1 MPa to 6 MPa, from 5.2 MPa to 6 MPa, from 5.3 MPa to 6 MPa, from 5.4 MPa to 6 MPa, from 5.5 MPa to 6 MPa, from 5.6 MPa to 6 MPa, from 5.7 MPa to 6 MPa, from 5.8 MPa to 6 MPa, or even from 5.9 MPa to 6 MPa. It should be understood that the pressure of the hydrodealkylation-transalkylation reactor may be from any lower bound for such pressure disclosed herein to any upper bound for such pressure disclosed herein. Without intending to be bound by any particular theory, it is believed that a pressure below 1.5 MPa may be insufficient for the hydrodealkylation and/or transalkylation to take place. However, at a pressure above 6 MPa, specialized high-pressure equipment may become necessary, which would increase the cost of performing the reaction.

The second stream comprising BTX from the hydrodealkylation-transalkylation reaction unit may be processed in an ARC where it undergoes several processing steps in order to recover high value products, e.g., xylenes and benzene, and to convert lower value products, e.g., toluene, into higher value products. For example, the aromatics present may be separated into different fractions by carbon number; e.g. benzene, toluene, xylenes, and ethylbenzene, etc. The $C_8$ fraction may then be subjected to a processing scheme to prepare para-xylene ("p-xylene"), which is a high value product. P-xylene may be recovered in high purity from the $C_8$ fraction by separating the p-xylene from the ortho-xylene ("o-xylene"), meta-xylene ("m-xylene"), and ethylbenzene using selective adsorption or crystallization. The o-xylene and m-xylene remaining from the p-xylene separation may be isomerized to produce an equilibrium mixture of xylenes. The ethylbenzene may be isomerized into xylenes or dealkylated to benzene and ethane. The p-xylene of the equilibrium mixture may also be separated from the o-xylene and the m-xylene using adsorption or crystallization, and the p-xylene-depleted stream may be recycled to the isomerization unit and then to the p-xylene recovery unit until all of the o-xylene and m-xylene are converted to p-xylene and recovered, or at least until it is no longer economically feasible to attempt to convert additional p-xylene.

In embodiments, toluene may be recovered as a separate fraction and then may be converted into higher value products, e.g., benzene and/or xylenes. An exemplary toluene conversion process may involve the disproportionation of toluene to make benzene and xylenes. Another exemplary process may involve the hydrodealkylation of toluene to make benzene by cycling the toluene to the hydrodealkylation-transalkylation unit.

The ARC may also produce aromatic bottoms stream rich in $C_9$-$C_{10}$ aromatic hydrocarbons. At least a portion of these $C_9$-$C_{10}$ aromatic hydrocarbons may be recycled to the hydrodealkylation-transalkylation unit.

In embodiments, the processing in the ARC may further produce a paraffinic stream rich in, for example, $C_5$-$C_6$ non-aromatic hydrocarbons. This paraffinic stream may be recycled back to the aromatization unit to proceed through the process.

In embodiments, instead of initiating the method by adding pyrolysis gasoline to the aromatization unit, the pygas may be added to the ARC directly. In these embodiments, the paraffinic stream produced by processing the pygas in the ARC may be passed to the aromatization unit. The process may then be performed as described above, producing BTX from the paraffinic stream that can be further processed to yield the higher value aromatic hydrocarbons.

FIG. 1, provides a process flow diagram for an exemplary process in accordance with embodiments described herein. A pygas upgrading system 100 includes a pygas aromatization unit 20, a hydrotreatment unit 10, a hydrodealkylation-transalkylation unit 130, and an ARC 30.

Pygas, from a steam cracker for instance, may be added to the pygas aromatization unit 20 via conduit 12, where it may be processed as described above, thereby resulting in a first stream comprising BTX. The first stream comprising BTX may be sent to the hydrotreatment unit 10 via conduit 14, thereby producing a de-olefinated stream comprising BTX. The de-olefinated stream comprising BTX may be sent to the hydrodealkylation-transalkylation unit 130 via conduit 16, along with hydrogen, thereby producing a second stream comprising BTX. This aromatic-rich second stream comprising BTX may then be sent to an ARC 30 via conduit 18 to isolate the BTX.

Figure 2:
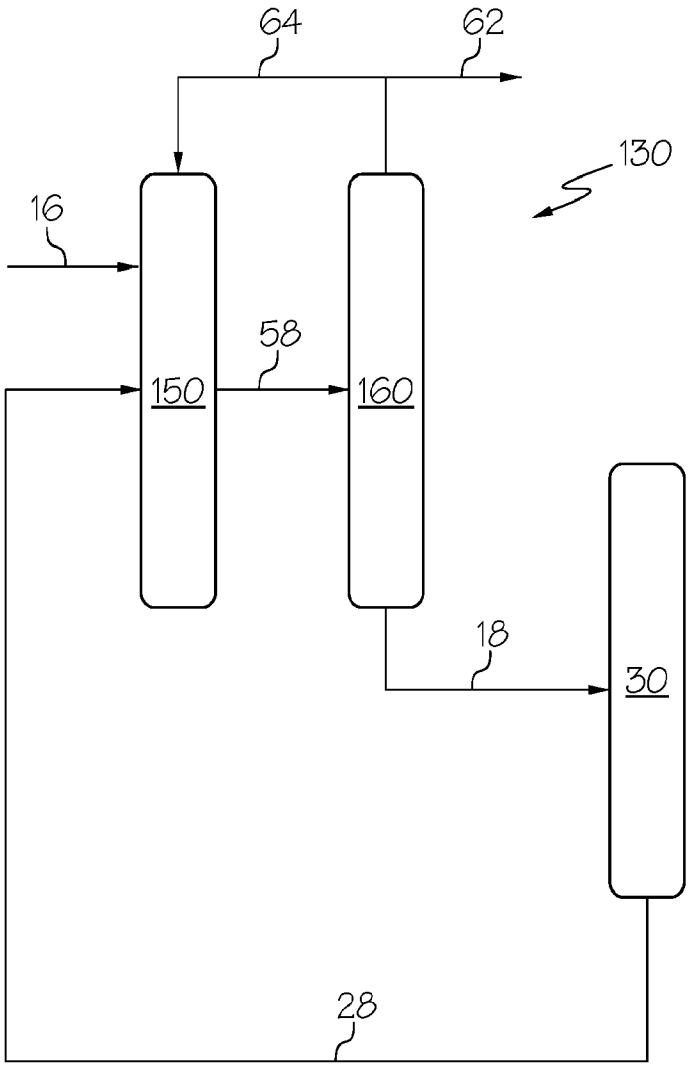
FIG. 2 is a schematic of an exemplary hydrodealkylation-transalkylation unit that may be used in accordance with embodiments described herein.

FIG. 2 provides a schematic diagram of an exemplary hydrodealkylation-transalkylation unit 130. The de-olefinated stream comprising BTX of FIG. 1 is sent to a transalkylation reactor 150 via conduit 16. Hydrogen gas may also be added to the transalkylation reactor 150 either with the de-olefinated stream comprising BTX or independently. The effluents from the transalkylation reactor 150 may be sent to a splitter 160 via conduit 58 to separate the effluents into a gaseous stream and a liquid stream. The liquid stream may be enriched in BTX. In embodiments, splitter 160 may include one or two columns operated from 250° C. to 300° C. and from 0.35 MPa to 0.65 MPa above atmospheric pressure (atmospheric pressure being about 0.1 MPa at sea level). The gaseous stream may be recovered via conduit 62 or be recycled to the transalkylation reactor 150 via conduit 64. The liquid stream may be sent to ARC 30 via conduit 18. Toluene ("$C_7$") recovered in ARC 30 and collected via conduit 28 may be recycled to transalkylation reactor 150.

Figure 3:
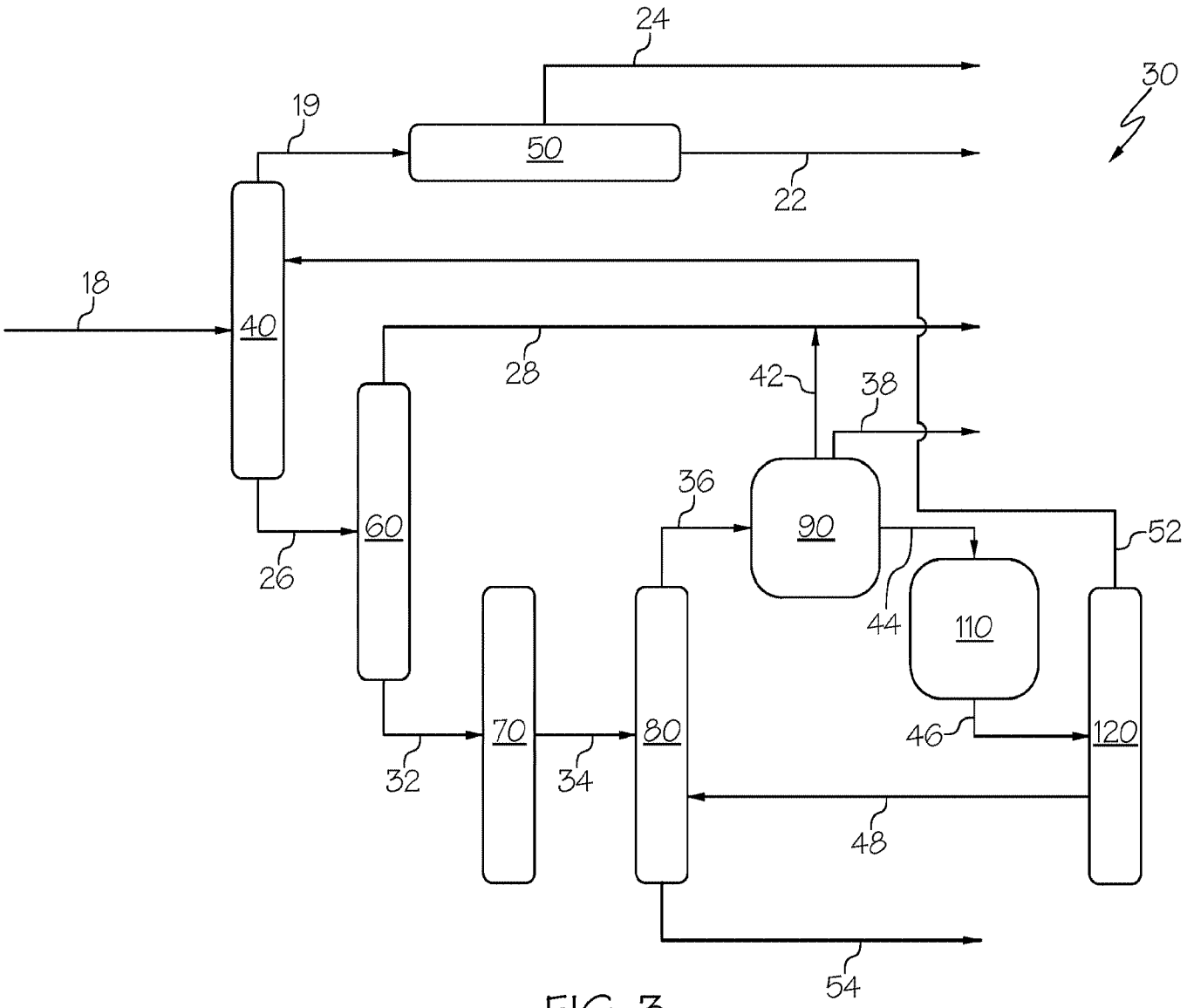
FIG. 3. is a schematic diagram of an exemplary aromatics recovery complex that may be used in accordance with embodiments described herein.

As shown in FIG. 3, which is a schematic of an exemplary ARC 30, one or more of the aromatic-rich product streams from the hydrodealkylation-transalkylation unit 130 may be provided to the ARC 30. For example, the liquid stream may enter ARC 30 via conduit 18 and pass into splitter 40. This splitter may have a top zone and a bottom zone. The top zone may be operated at a pressure from 0.3 MPa to 0.5 MPa above atmospheric pressure and a temperature from 70° C.

to 90° C. The bottom zone may be operated at a higher temperature, such as from 150° C. to 200° C., for example.

The aromatic-rich stream may be split into two fractions: a light stream with $C_5$-$C_6$ hydrocarbons and a heavy stream with $C_7$ and greater ("$C_7$+") hydrocarbons. The light stream may be sent to a benzene extraction unit 50 via conduit 19 to extract the benzene, recoverable via conduit 22, and to recover substantially benzene-free gasoline as raffinate motor gasoline ("mogas") including $C_5$-$C_6$ non-aromatic hydrocarbons, recoverable via conduit 24. As used herein, the term "substantially benzene-free" refers to a stream that has less than or equal to 1000 ppm benzene. The heavy stream may be sent to a first splitter 60 via conduit 26, the top zone of which may be operated at a pressure from 0.3 MPa to 0.5 MPa above atmospheric pressure and a temperature from 80° C. to 100° C., thereby producing a $C_7$ cut mogas stream, recoverable via conduit 28, and a $C_8$ and greater ("$C_8$+) hydrocarbon stream, which may be sent to a clay treater 70 via conduit 32.

The resulting clay treated $C_8$+ stream may be fed to a xylene rerun unit 80 via conduit 34, which separates the $C_8$+ hydrocarbons into a $C_8$ hydrocarbon stream and a $C_9$+ hydrocarbon stream ("heavy aromatic mogas"). The $C_8$ hydrocarbon stream may be sent to a p-xylene extraction unit 90 via conduit 36 to recover p-xylene via conduit 38. P-xylene extraction unit 90 also produces a $C_7$ cut mogas stream, which may be added to conduit 28 via conduit 42 to be recovered with the $C_7$ cut mogas from the first splitter 60. The $C_8$+ stream from the hydrodealkylation-transalkylation unit 130 may also be added to the p-xylene extraction unit 90.

O-xylenes and m-xylenes may be recovered and sent to xylene isomerization unit 110 via conduit 44 to convert them to p-xylene, which may be sent to splitter 120 via conduit 46. The splitter 120 may operate at a top zone pressure from 0.3 MPa to 0.5 MPa above atmospheric pressure. The converted fraction, which is rich in p-xylenes, may be recycled to xylene rerun unit 80 via conduit 48. The top stream from the second splitter 120 may be recycled to splitter 40 via conduit 52. The heavy fraction from the xylene rerun unit 80 may be recovered as process reject or aromatic bottoms, which is rich in $C_9$+ aromatic hydrocarbons. This aromatic bottoms stream is recoverable via conduit 54.

Returning to FIG. 1, once the aromatic-rich stream has passed through the ARC 30, the desired products, including BTX, may be extracted from the ARC 30. For instance, the raffinate mogas ("$C_5$-$C_6$ non-aromatic hydrocarbons") may be collected via conduit 24, benzene ("$C_6$") may be collected via conduit 22, toluene ("$C_7$") may be collected via conduit 28, xylenes ("$C_8$" including p-xylenes) may be collected via conduit 38, and the aromatic bottoms ("$C_9$+") may be collected via conduit 54. Furthermore, in embodiments, the raffinate mogas may be recycled to pygas aromatization unit 20 via conduit 78. In embodiments, the $C_9$+ may be recycled to the hydrodealkylation-transalkylation unit 130 via conduit 81. These optional recycling embodiments may increase the yield of BTX by converting a greater percentage of the raffinate mogas and $C_9$+ hydrocarbons to the more desirable BTX.

Figure 4:
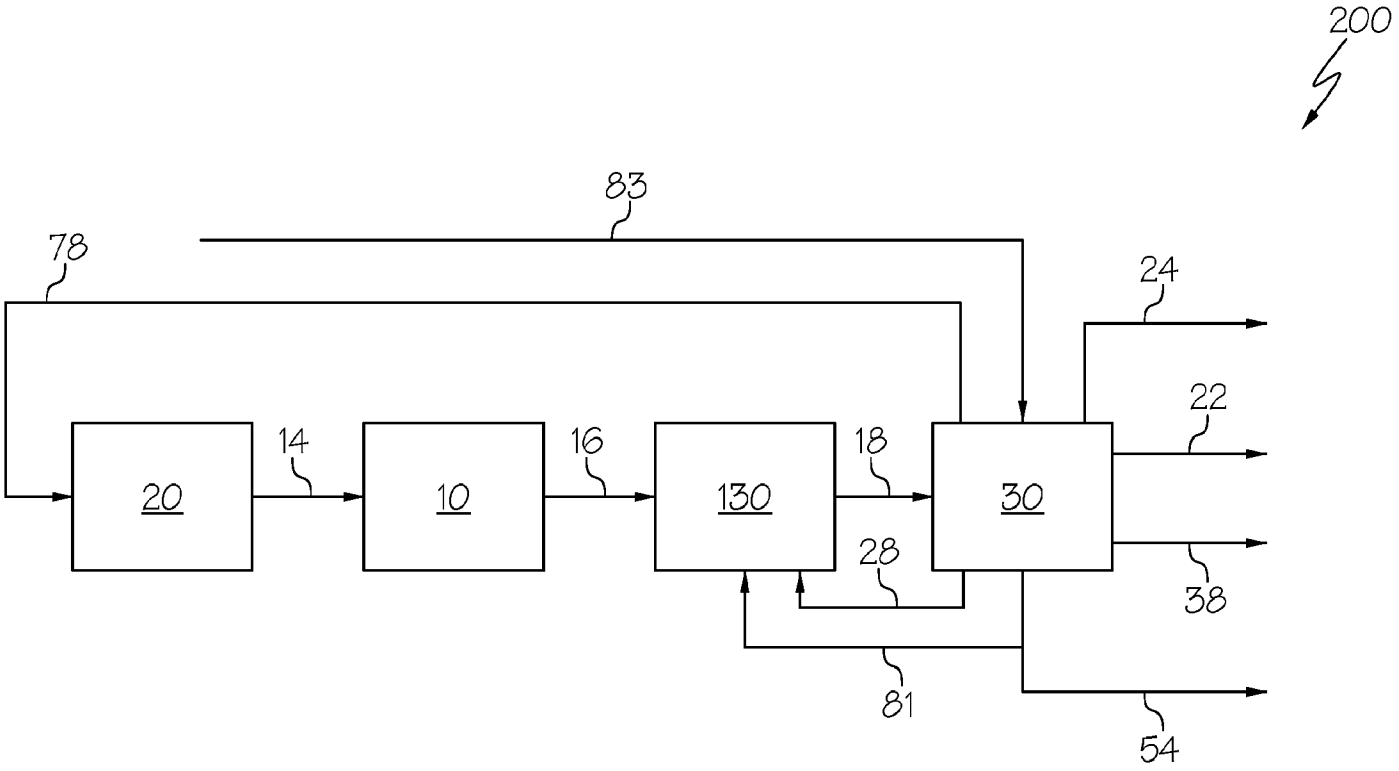
FIG. 4 is a process flow diagram for an exemplary process in accordance with embodiments described herein.

FIG. 4 shows a process flow diagram for a second exemplary process in accordance with embodiments described herein. A pygas upgrading system 200 includes a pygas aromatization unit 20, a hydrotreatment unit 10, a hydrodealkylation-transalkylation unit 130, and an ARC 30.

Pygas, from a steam cracker for instance, may be added to the ARC 30 via conduit 83, where it may be processed as described above, thereby resulting in raffinate and aromatic-rich streams. For instance, raffinate mogas ("$C_5$-$C_6$ non-aromatic hydrocarbons") may be collected via conduit 24, benzene ("$C_6$") may be collected via conduit 22, xylenes ("$C_8$" including p-xylenes) may be collected via conduit 38, and the aromatic bottoms ("$C_9$+") may be collected via conduit 54. Furthermore, at least a portion of the raffinate mogas may be recycled to pygas aromatization unit 20 via conduit 78. This raffinate stream then proceeds through the pygas upgrading system 200, as described above. Briefly, aromatizing the raffinate stream produces the first stream comprising BTX, which may be sent to the hydrotreatment unit 10 via conduit 14, thereby producing a de-olefinated stream comprising BTX. The de-olefinated stream comprising BTX may be sent to the hydrodealkylation-transalkylation unit 130 via conduit 16, thereby producing a second stream comprising BTX. This aromatic-rich second stream comprising BTX may then be sent to an ARC 30 via conduit 18 to isolate the BTX. In embodiments, the $C_9$+ aromatics may be recycled to the hydrodealkylation-transalkylation unit 130 via conduit 81. Additionally, the toluene produced in ARC 30 may be recycled to the hydrodealkylation-transalkylation unit 130 via conduit 28. By recycling the toluene, the amount of more desirable benzene and p-xylenes may be increased.

Advantageously, the processes and systems described herein allow for the production of valuable BTX from pygas. Overall, the production of and BTX is greatly improved relative to processes and systems lacking the pygas aromatization unit prior to aromatics recovery.

According to an aspect, either alone or in combination with any other aspect, a method for producing aromatic compounds from pyrolysis gasoline comprising $C_5$-$C_6$ non-aromatic hydrocarbons includes aromatizing the pyrolysis gasoline in an aromatization unit, thereby converting the $C_5$-$C_6$ non-aromatic hydrocarbons to a first stream comprising benzene-toluene-xylenes (BTX); hydrotreating the first stream comprising BTX in a selective hydrotreatment unit, thereby producing a de-olefinated stream comprising BTX; hydrodealkylating and transalkylating the de-olefinated stream comprising BTX in a hydrodealkylation-transalkylation unit, thereby producing a second stream comprising BTX, the second stream comprising BTX having a greater amount of benzene and xylenes than the first stream comprising BTX; and processing the second stream comprising BTX in an aromatics recovery complex, thereby producing the aromatic compounds from the pyrolysis gasoline, the aromatic compounds comprising benzene, toluene, and xylenes.

According to a second aspect, either alone or in combination with any other aspect, the processing further produces a paraffinic stream.

According to a third aspect, either alone or in combination with any other aspect, the method further includes recycling the paraffinic stream to the aromatization unit.

According to a fourth aspect, either alone or in combination with any other aspect, the method further includes recycling the toluene to the hydrodealkylation-transalkylation unit.

According to a fifth aspect, either alone or in combination with any other aspect, the processing produces a stream comprising $C_9$-$C_{10}$ aromatic compounds, and the method further includes recycling at least a portion of the $C_9$-$C_{10}$ aromatic compounds to the hydrodealkylation-transalkylation unit.

According to a sixth aspect, either alone or in combination with any other aspect, the aromatizing comprises one or more of cyclization, dealkylation, and hydrodealkylation reactions.

According to a seventh aspect, either alone or in combination with any other aspect, the aromatizing is performed in a reactor having a temperature from 200° C. to 900° C.

According to an eighth aspect, either alone or in combination with any other aspect, the aromatizing is performed in a reactor having a weight hour space velocity from 0.1 $h^{-1}$ to 20 $h^{-1}$.

According to a ninth aspect, either alone or in combination with any other aspect, the aromatizing is performed in a reactor having a pressure from 0.1 MPa to 3 MPa.

According to a tenth aspect, either alone or in combination with any other aspect, the aromatizing comprises contacting one or both of the pyrolysis gasoline and the paraffinic stream with a catalyst comprising a Y-type zeolite, a ZSM-5-type zeolite, or a combination of the Y-type zeolite and the ZSM-5-type zeolite.

According to an eleventh aspect, either alone or in combination with any other aspect, the method further includes initiating the method by adding hydrotreated pygas to the aromatics recovery complex, thereby producing at least the paraffinic stream; and adding the paraffinic stream to the aromatization unit.

According to a twelfth aspect, either alone or in combination with any other aspect, the selective hydrotreatment unit comprises a reactor selected from the group consisting of a fixed-bed reactor, an ebullated-bed reactor, a moving bed reactor, a slurry bed reactor, and a combination of two or more thereof.

According to a thirteenth aspect, either alone or in combination with any other aspect, the reactor comprises a catalyst composition comprising an active-phase metal on a support.

According to a fourteenth aspect, either alone or in combination with any other aspect, the active-phase metal is selected from the group consisting of nickel, molybdenum, tungsten, platinum, palladium, rhodium, ruthenium, gold, and a combination of two or more of these; and the support is selected from the group consisting of amorphous alumina, crystalline silica-alumina, alumina, silica, and a combination of two or more thereof.

According to a fifteenth aspect, either alone or in combination with any other aspect, the reactor is operated at a temperature from 200° C. to 400° C.

According to a sixteenth aspect, either alone or in combination with any other aspect, the reactor is operated at a pressure from 2 MPa to 10 MPa.

According to a seventeenth aspect, either alone or in combination with any other aspect, the reactor is operated at a liquid hourly space velocity from 1 $h^{-1}$ to 8 $h^{-1}$.

According to an eighteenth aspect, either alone or in combination with any other aspect, the reactor is operated at a hydrogen-to-oil ratio from 100 LI to 2000 L/L.

Example

Using embodiments described above, an exemplary upgrading system and process was simulated using the HYSIS simulator, as follows. The following examples are merely illustrative and should not be interpreted as limiting the scope of the present disclosure.

HYSIS v. 10.0 was used to simulate the material balance for system without a pygas aromatization unit or a transalkylation unit (comparative), the system shown in FIG. 1 without recycling the raffinate from the ARC, and the system shown in FIG. 4 with raffinate recycling. Table 1 provides the simulated material balance for the comparative system. Table 2 provides the simulated material balance for the inventive system without recycling the raffinate, an example of which is shown in FIG. 1. Table 3 provides the simulated material balance for the inventive system with raffinate recycling and addition of a hydrotreated pygas stream, an example of which is shown in FIG. 4.

TABLE 1

Material balance for comparative system without an aromatization unit (all values in kg)

| Species | In | After HT | Raffinate | $C_6$-rich | $C_7$-rich | $C_8$-rich | Aromatic Bottoms |
|---|---|---|---|---|---|---|---|
| $H_2$ | 0.0 | 0.0 | 0.0 | 0.0 | 0.0 | 0.0 | 0.0 |
| $C_1$-$C_4$ | 0.0 | 0.0 | 0.0 | 0.0 | 0.0 | 0.0 | 0.0 |
| $C_5$+ paraffins | 19.17 | 35.6 | 35.6 | 0.0 | 0.0 | 0.0 | 0.0 |
| Naphthenes | 2.34 | 2.34 | 2.34 | 0.0 | 0.0 | 0.0 | 0.0 |
| Mono-olefins | 7.69 | 0.0 | 0.0 | 0.0 | 0.0 | 0.0 | 0.0 |
| Di-olefins | 8.5 | 0.0 | 0.0 | 0.0 | 0.0 | 0.0 | 0.0 |
| Benzene | 34.2 | 34.2 | 0.0 | 34.2 | 0.0 | 0.0 | 0.0 |
| Toluene | 13.8 | 13.8 | 0.0 | 0.0 | 13.8 | 0.0 | 0.0 |
| Ethyl-benzene | 1.3 | 1.3 | 0.0 | 0.0 | 0.0 | 1.3 | 0.0 |
| Xylene | 2.5 | 2.5 | 0.0 | 0.0 | 0.0 | 2.5 | 0.0 |
| $C_9$+ aromatics | 10.5 | 10.5 | 0.0 | 0.0 | 0.0 | 0.0 | 10.5 |
| Total | 100 | 100 | 37.7 | 34.2 | 13.8 | 3.8 | 10.5 |

TABLE 2

Material balance for inventive system without raffinate recycling (all values in kg)

| Species | In | Pygas Aromatics | After Transalkylation | Raffinate | $C_6$-rich | $C_7$-rich | $C_8$-rich | Aromatic Bottoms |
|---|---|---|---|---|---|---|---|---|
| $H_2$ | 0.0 | 0.2 | 0.2 | 0.2 | 0.0 | 0.0 | 0.0 | 0.0 |
| $C_1$-$C_4$ | 0.0 | 10.68 | 11.9 | 11.9 | 0.0 | 0.0 | 0.0 | 0.0 |
| $C_5$+ paraffins | 37.7 | 6.59 | 6.6 | 6.6 | 0.0 | 0.0 | 0.0 | 0.0 |
| Benzene | 34.2 | 40.3 | 53.9 | 0.0 | 53.9 | 0.0 | 0.0 | 0.0 |
| Toluene | 13.8 | 26.34 | 0.0 | 0.0 | 0.0 | 0.0 | 0.0 | 0.0 |
| Ethylbenzene | 1.3 | 1.3 | 0.0 | 0.0 | 0.0 | 0.0 | 0.0 | 0.0 |
| Xylene | 2.5 | 2.61 | 21.1 | 0.0 | 0.0 | 0.0 | 21.1 | 0.0 |
| $C_9$+ aromatics | 10.5 | 11.98 | 6.3 | 0.0 | 0.0 | 0.0 | 0.0 | 6.3 |
| Total | 100 | 100 | 100 | 18.7 | 53.9 | 0 | 21.1 | 6.3 |

TABLE 3

Material balance for inventive system with raffinate recycling (all values in kg)

| Species | In | Raffinate Recycle | Pygas Aromatics | After Trans-alkylation | Raffinate |
|---|---|---|---|---|---|
| $H_2$ | 0.0 | 0.0 | 0.2 | 0.2 | 0.2 |
| $C_1$-$C_4$ | 0.0 | 0.0 | 12.7 | 12.7 | 12.7 |
| $C_5$+ paraffins | 37.7 | 44.3 | 7.7 | 7.7 | 1.1 |
| Benzene | 34.2 | 0.0 | 7.2 | 23.2 | 0.0 |
| Toluene | 13.8 | 0.0 | 14.7 | 13.6 | 0.0 |
| Ethylbenzene | 1.3 | 0.0 | 0.0 | 0.0 | 0.0 |
| Xylene | 2.5 | 0.0 | 0.1 | 20 | 0.0 |
| $C_9$+ aromatics | 10.5 | 0.0 | 1.7 | 6.6 | 0.0 |
| Total | 100 | 44.3 | 44.3 | 84 | 14 |

| Species | $C_6$-rich | $C_7$-rich | $C_8$-rich | Aromatic Bottoms | Aromatic Bottoms Recycle |
|---|---|---|---|---|---|
| $H_2$ | 0.0 | 0.0 | 0.0 | 0.0 | 0.0 |
| $C_1$-$C_4$ | 0.0 | 0.0 | 0.0 | 0.0 | 0.0 |
| $C_5$+ paraffins | 0.0 | 0.0 | 0.0 | 0.0 | 0.0 |
| Benzene | 57.4 | 0.0 | 0.0 | 0.0 | 0.0 |
| Toluene | 0.0 | 0.0 | 0.0 | 0.0 | 0.0 |
| Ethylbenzene | 0.0 | 0.0 | 0.0 | 0.0 | 0.0 |
| Xylene | 0.0 | 0.0 | 22.5 | 0.0 | 0.0 |
| $C_9$+ aromatics | 0.0 | 0.0 | 0.0 | 6.6 | 10.5 |
| Total | 57.4 | 0.0 | 22.5 | 6.6 | 10.5 |

As shown in the Tables, without the aromatization unit, 51.8 kg of BTX (34.2 kg+13.8 kg+3.8 kg) are simulated to be produced from 100 kg of a pygas feedstock. However, by aromatizing and hydrodealkylating/transalkylating the pygas, 75 kg of BTX (53.9 kg+21.1 kg) may be produced from 100 kg of a pygas feedstock. Further, the amount of BTX produced when adding recycling the raffinate (Table 3) is much greater than when simulating the same system without the raffinate recycle. With the raffinate recycle, 109.1 kg of BTX (57.4 kg+29.2 kg+22.5 kg) are simulated to be produced, but without the raffinate recycle, only 75 kg of BTX (53.9 kg+21.1 kg) are simulated to be produced.

It is noted that recitations in the present disclosure of a component of the present disclosure being "operable" or "sufficient" in a particular way, to embody a particular property, or to function in a particular manner, are structural recitations, as opposed to recitations of intended use. More specifically, the references in the present disclosure to the manner in which a component is "operable" or "sufficient" denotes an existing physical condition of the component and, as such, is to be taken as a definite recitation of the structural characteristics of the component.

Having described the subject matter of the present disclosure in detail and by reference to specific embodiments, it is noted that the various details disclosed in the present disclosure should not be taken to imply that these details relate to elements that are essential components of the various embodiments described in the present disclosure. Further, it will be apparent that modifications and variations are possible without departing from the scope of the present disclosure, including, but not limited to, embodiments defined in the appended claims.

The singular forms "a", "an" and "the" include plural referents, unless the context clearly dictates otherwise.

Throughout this disclosure ranges are provided. It is envisioned that each discrete value encompassed by the ranges are also included. Additionally, the ranges which may be formed by each discrete value encompassed by the explicitly disclosed ranges are equally envisioned.

As used in this disclosure and in the appended claims, the words "comprise," "has," and "include" and all grammatical variations thereof are each intended to have an open, non-limiting meaning that does not exclude additional elements or steps.

As used in this disclosure, terms such as "first" and "second" are arbitrarily assigned and are merely intended to differentiate between two or more instances or components. It is to be understood that the words "first" and "second" serve no other purpose and are not part of the name or description of the component, nor do they necessarily define a relative location, position, or order of the component. Furthermore, it is to be understood that the mere use of the term "first" and "second" does not require that there be any "third" component, although that possibility is contemplated under the scope of the present disclosure.

What is claimed is:

1. A method for producing aromatic compounds from pyrolysis gasoline comprising $C_5$-$C_6$ non-aromatic hydrocarbons, the method comprising:

aromatizing the pyrolysis gasoline in an aromatization unit, thereby converting the $C_5$-$C_6$ non-aromatic hydrocarbons to a first stream comprising benzene-toluene-xylenes (BTX);

hydrotreating the first stream comprising BTX in a selective hydrotreatment unit, thereby producing a de-olefinated stream comprising BTX, wherein the first stream comprising BTX is sent directly from a reactor of the aromatization unit to the selective hydrotreatment unit;

hydrodealkylating and transalkylating the de-olefinated stream comprising BTX in a hydrodealkylation-transalkylation unit comprising hydrogen, thereby producing a second stream comprising BTX, the second stream comprising BTX having a greater amount of benzene and xylenes than the first stream comprising BTX; and processing the second stream comprising BTX in an aromatics recovery complex, thereby producing the aromatic compounds from the pyrolysis gasoline, the aromatic compounds comprising benzene, toluene, and xylenes.

2. The method of claim 1, wherein the processing further produces a paraffinic stream.

3. The method of claim 2, wherein the aromatizing comprises contacting one or both of the pyrolysis gasoline and the paraffinic stream with a catalyst comprising a Y-type zeolite, a ZSM-5-type zeolite, or a combination of the Y-type zeolite and the ZSM-5-type zeolite.

4. The method of claim 2, further comprising:

recycling the paraffinic stream to the aromatization unit.

5. The method of claim 1, further comprising:

recycling the toluene to the hydrodealkylation-transalkylation unit.

6. The method of claim 1, wherein the processing produces a stream comprising $C_9$-$C_{10}$ aromatic compounds, and the method further comprises:

recycling at least a portion of the $C_9$-$C_{10}$ aromatic compounds to the hydrodealkylation-transalkylation unit.

7. The method of claim 1, wherein the aromatizing comprises one or more of cyclization, dealkylation, and hydrodealkylation reactions.

8. The method of claim 1, wherein the aromatizing is performed in the reactor having a temperature from 200° C. to 700° C.

9. The method of claim 1, wherein the aromatizing is performed in the reactor having a weight hour space velocity from 0.1 $h^{-1}$ to 20 $h^{-1}$.

10. The method of claim 1, wherein the aromatizing is performed in the reactor having a pressure from 0.1 MPa to 3 MPa.

11. The method of claim 1, wherein the selective hydrotreatment unit comprises a reactor selected from the group consisting of a fixed-bed reactor, an ebullated-bed reactor, a moving bed reactor, a slurry bed reactor, and a combination of two or more thereof.

12. The method of claim 11, wherein the reactor comprises a catalyst composition comprising an active-phase metal on a support.

13. The method of claim 12, wherein:

the active-phase metal is selected from the group consisting of nickel, molybdenum, tungsten, platinum, palladium, rhodium, ruthenium, gold, and a combination of two or more of these; and the support is selected from the group consisting of amorphous alumina, crystalline silica-alumina, alumina, silica, and a combination of two or more thereof.

14. The method of claim 11, wherein the reactor of the selective hydrotreatment unit is operated at a temperature from 160° C. to 400° C.

15. The method of claim 11, wherein the reactor of the selective hydrotreatment unit is operated at a pressure from 2 MPa to 10 MPa.

16. The method of claim 11, wherein the reactor of the selective hydrotreatment unit is operated at a liquid hourly space velocity from 1 $h^{-1}$ to 8 $h^{-1}$.

17. The method of claim 11, wherein the reactor of the selective hydrotreatment unit is operated at a hydrogen-to-oil ratio from 100 L/L to 2000 L/L.

18. The method of claim 1, wherein the de-olefinated stream comprising BTX is sent directly from the selective hydrotreatment unit to the hydrodealkylation-transalkylation unit.

19. A method for producing aromatic compounds from a feed stream comprising $C_5$-$C_6$non-aromatic hydrocarbons, the method comprising:

aromatizing the feed stream in an aromatization unit, thereby converting the $C_5$-$C_6$ non-aromatic hydrocarbons to a first stream comprising benzene-toluene-xylenes (BTX);

hydrotreating the first stream comprising BTX in a selective hydrotreatment unit, thereby producing a de-olefinated stream comprising BTX;

hydrodealkylating and transalkylating the de-olefinated stream comprising BTX in a hydrodealkylation-transalkylation unit comprising hydrogen, thereby producing a second stream comprising BTX, the second stream comprising BTX having a greater amount of benzene and xylenes than the first stream comprising BTX, wherein the de-olefinated stream comprising BTX is sent directly from a reactor of the selective hydrotreatment unit to the hydrodealkylation-transalkylation unit; and processing the second stream comprising BTX in an aromatics recovery complex, thereby producing the aromatic compounds from the feed stream, the aromatic compounds comprising benzene, toluene, and xylenes.

20. A method for producing aromatic compounds, the method comprising:

adding hydrotreated pygas to an aromatics recovery complex, thereby producing a paraffinic stream comprising $C_5$-$C_6$non-aromatic hydrocarbons;

aromatizing the paraffinic stream in an aromatization unit, thereby converting the $C_5$-$C_6$ non-aromatic hydrocarbons to a first stream comprising benzene-toluene-xylenes (BTX);

hydrotreating the first stream comprising BTX in a selective hydrotreatment unit, thereby producing a de-olefinated stream comprising BTX;

hydrodealkylating and transalkylating the de-olefinated stream comprising BTX in a hydrodealkylation-transalkylation unit comprising hydrogen, thereby producing a second stream comprising BTX, the second stream comprising BTX having a greater amount of benzene and xylenes than the first stream comprising BTX; and processing the second stream comprising BTX in the aromatics recovery complex, thereby producing the aromatic compounds, the aromatic compounds comprising benzene, toluene, and xylenes.

* * * * *